US006555768B2

(12) United States Patent
Deruginsky et al.

(10) Patent No.: US 6,555,768 B2
(45) Date of Patent: Apr. 29, 2003

(54) 3D ROLLER KEY

(75) Inventors: Michael Deruginsky, Aalholmparken (DK); Soren Ravnkilde, Baltorpvej (DK)

(73) Assignee: Soniontech A/S, Roskilde (DK)

( * ) Notice: Subject to any disclaimer, the term of this patent is extended or adjusted under 35 U.S.C. 154(b) by 172 days.

(21) Appl. No.: 09/742,298

(22) Filed: Dec. 22, 2000

(65) Prior Publication Data

US 2001/0019012 A1 Sep. 6, 2001

(30) Foreign Application Priority Data

Jan. 14, 2000 (DK) ..... 2000 00057

(51) Int. Cl.[7] ..... H01H 9/00
(52) U.S. Cl. ..... 200/4; 200/11 R; 200/11 A
(58) Field of Search ..... 200/4, 11 R, 11 A, 200/11 D, 11 DA, 11 G, 11 J, 11 K, 11 TW

(56) References Cited

U.S. PATENT DOCUMENTS 5,446,481 A 8/1995 Gillick et al.
5,987,336 A 11/1999 Sudo et al.
6,097,964 A * 8/2000 Nuovo et al. ..... 455/550
6,211,474 B1 * 4/2001 Takahashi ..... 200/18
6,218,635 B1 * 4/2001 Shigemoto et al. ..... 200/570
6,333,473 B1 * 12/2001 Sawada et al. ..... 200/4

FOREIGN PATENT DOCUMENTS

| | | |
|---|---|---|
| EP | 901262 A2 | 3/1999 |
| EP | 1014410 A1 | 6/2000 |
| GB | 2329070 A | 10/1999 |
| GB | 2329083 A | 10/1999 |
| GB | 2329094 A | 10/1999 |
| WO | WO 9919861 | 4/1999 |

* cited by examiner

*Primary Examiner*—Elvin Enad
*Assistant Examiner*—Kyung S. Lee
(74) *Attorney, Agent, or Firm*—Harness, Dickey & Pierce PLC.

(57) ABSTRACT

The present invention relates to encoder-switch assemblies, such as electromechanical roller-key assemblies comprising an encoder part and two or more actuator switches. The encoder part operates in accordance to magnetic, optical and/or electromechanical principles and provides one or several electrical output signals indicating the instantaneous change of angular position of a rotating roller or tuning wheel. The actuator switches provide two or more electrical output signals indicating a plurality of positions of the roller-key or wheel of the assembly.

34 Claims, 4 Drawing Sheets

3D ROLLER KEY

FIELD OF THE INVENTION

The present invention relates to encoder-switch assemblies such as electromechanical roller-key assemblies that comprise an encoder part and two or more actuator switches. The encoder part may operate according to magnetic, optical and/or electromechanical principles and may provide one or several electrical output signals indicating the instantaneous change of angular position of a rotating roller or tuning wheel. The actuator switches provide two or more electrical output signals indicating a first or a second displaced position of the roller or wheel of the assembly.

The present encoder-switch assemblies are particularly well adapted for use in mobile phones or, generally, in any type of electronic equipment that will benefit from the very small outer dimensions and simple construction of the present encoder-switch assemblies.

BACKGROUND OF THE INVENTION

Electromechanical roller-key assemblies which may be used to generate digital control signals in response to a rotation of a roller or tuning knob and to generate an actuator switch signal in response to a depression of the roller are known from e.g. mobile phones. However, the mechanical constructions of these known devices have certain drawbacks due to a large number of miniature movable and stationary parts, often including a tiny detent spring element. This large number of separate parts requires a quite complex and labour intensive assembly procedure to assure that all parts are carefully aligned with respect to each other.

Electromechanical roller-key assemblies are often used to navigate in menus on an electric display of an apparatus. The number and the complexity of functions require that the navigation means can operate in tables and extended menu structures.

Accordingly, there is a need for an encoder-switch assembly of simplified construction with fewer parts than prior art assemblies so as to simplify the assembly procedure, reduce the assembly time and, consequently, lower the costs of integrating such encoder-switch assemblies in today's mobile phones and similar compact electronic equipment. Also, there is a need for an encoder-switch assembly, which provides extended navigation possibilities.

SUMMARY OF THE INVENTION

It is an object of the invention to provide an electromechanical roller-key assembly of simple and robust construction which assembly may be integrated in electronic equipment and generate digital control signals in response to the instantaneous change in angular position of a user operated roller.

It is also an object of the invention to provide an electromechanical roller-key assembly suitable for being manufactured with very small outer dimensions, since such miniaturisation is a key requirement for applications such as hearing aids, compact mobile phones pagers, medical dispensing devices and similar handheld or body-worn devices, etc.

It is further an object of the invention to provide an electromechanical roller-key assembly comprising fewer and simpler mechanical parts compared to prior art roller-key assemblies, thereby making the present electromechanical roller-key assembly suitable for a simplified and automated factory assembly.

It is a still further object of the invention to provide an electromechanical roller-key assembly which in addition to the signals representing the rotation of the roller key provides switch signal outputs corresponding to at least four different logic states.

It is a still further object of the invention to provide methods for navigating and selecting items in tables and menus on an electronic display using a single roller key.

In a first aspect, the present invention provides a roller-key assembly, which is of a specific type comprising:

- a carrier,
- a roller member supported by the carrier and being rotatably mounted in relation to the carrier,
- a coding member engaging the roller member in a manner so as to rotate when the roller member rotates,
- the carrier being mounted in a supporting structure and being at least partly displaceable relative to the supporting structure so as to render the roller member displaceable from an initial position to a selected displaced position out of at least two predetermined displaced positions,
- means for detecting rotation of the coding member in relation to the supporting structure,
- means for generating a return spring force that returns the roller member to the initial position from the selected displaced position, and
- switching means being adapted to indicate the selected displaced position of the roller member.

The switching means typically comprises at least two separate switching means such as two actuator contacts, wherein the first is adapted to generate a first switch signal indicating that the roller member is in a first predetermined position, and the second is adapted to generate a second switch signal indicating that the roller member is in a second predetermined position. Optionally, the roller member is furthermore displaceable to a third predetermined displaced position. In this case, the switching means may further comprise a third switching means adapted to generate a third switch signal indicating that the roller member is in the third predetermined position. Alternatively the third predetermined displaced position of the roller member is indicated by a combination of the first and second switch signals.

Preferably the selected displaced position is chosen by applying a predetermined force to an associated part of the roller member:

- the first predetermined displaced position is selected by applying the predetermined force to a first end part of the roller member,
- the second predetermined displaced position is selected by applying the predetermined force to a second end part of the roller member, and
- if the roller member is furthermore displaceable to a third predetermined displaced position, the third displaced position is selected by applying the predetermined force to a substantially middle part of the roller member.

The carrier may comprise a first and a second part, where the first part is substantially rigidly connected to the frame and the second part is adapted to support the roller member and is displaceable relative to the first part of the carrier. Thereby, a torque spring force are constituted by the carrier so as to return the second part to a relaxed position when the second part is displaced to a relative to the first part. In this case, the carrier is preferably made from a plate-shaped resilient material. One or more indentations may separate first and second parts of the carrier in order to provide regions with a higher resiliency than regions of the carrier abutting the one or more indentations.

When the roller member is displaced to one of the predetermined displaced positions, it is preferred that the carrier actuates the switching means, e.g. by protrusions on the second part of the carrier. Alternatively the roller member is adapted to actuate the switching means when it is displaced.

The switching means may comprise one or several membrane switches. Optionally, such membrane switches may comprise a resilient material and be adapted to provide a return spring force to the roller member or the carrier when the roller member and the carrier are displaced towards the switching means. Alternatively, the resilient material may not form part of the switching means but be arranged between the switching means and the roller member so as to provide the return spring force to the roller member or the carrier when the roller member and the carrier are displaced towards the switching means. The resilient material may be any material selected from the group of: rubber, plastic, foam, metal, metal alloys.

The supporting structure of the roller-key assembly according to the present invention may constitute a frame supporting at least part of the carrier.

In order to transmit the rotation from the roller member to the coding member, the roller-key assembly may comprise a shaft providing a substantially rotationally rigid connection between the roller member and the coding member. The shaft is mounted so as to allow different parts of the roller member to be displaced in relation to the coding member along directions substantially perpendicular to the axis of rotation of the roller member. Preferably, the roller member comprises a bore wherein at least part of the shaft is positioned.

The encoder part, that is coding member and the means for detecting rotation of the coding member, may operate according to magnetic, optical and/or electromechanical principles. In order to protect the mechanical, electrical, magnetic or optic components from contamination, the encoder part is preferably arranged inside a substantially moisture- or watertight cavity, parts of which is formed in the frame.

Also, in order to protect the mechanical and electric parts of the switching means and the other components of the apparatus holding the roller-key assembly, the roller-key assembly may further comprise a sealing foil arranged between the switching means and the roller member so as to separate the switching means from the roller member by a substantially moisture- or watertight layer. The supporting structure and the sealing foil, said well having an opening arranged oppositely to the sealing foil may form a substantially moisture- or watertight well wherein the roller member and preferably the carrier is mounted. The roller-key assembly may further comprise means for draining liquids and small particles from within the well, e.g. in the form of a pipe or hose with a first opening positioned within the well.

In another embodiment of the present invention, a hand-held electronic apparatus comprising the above described roller-key assembly is provided. Such hand-held electronic apparatus may be selected from the group of: mobile phones, remote controls, pagers, handheld computers, discmans, MP3-mans, GPS navigators or personal digital assistant.

The hand-held electronic apparatus may further comprise a controller operationally connected to the switching means of the roller-key assembly and adapted to receive the first and second switch signals. The controller is adapted to generate a first output if the first switch signal precedes the second switch signal with more than a first delay time, $\Delta t_1$, and a second output if the second switch signal precedes the first switch signal with more than $\Delta t_1$. Thereby the first output from the controller indicates that the first predetermined displaced position was selected and the second output indicates that the second predetermined displaced position was selected. The output from the controller is preferably a digital output.

If the roller member is furthermore displaceable to a third predetermined displaced position, and if this third displaced position is indicated by a combination of the first and second switch signals, the controller is further adapted to generate a third output if the time interval between the first switch signal and the second switch signal is less than a second delay time, $\Delta t_2$. Thereby, the third output indicates that the third predetermined displaced position was selected.

Preferably the value of $\Delta t_1$ equals the value of $\Delta t_2$, and preferably the time interval $\Delta t_1$ is larger than 10 ms or 25 ms, such as larger than 50 ms or 100 ms. Accordingly, the time interval $\Delta t_2$ is preferably smaller than 100 ms or 50 ms, such as smaller than 25 ms or 10 ms.

In a second aspect, the present invention provides a method of navigating on an electronic display displaying one or more items. Such items may be tables, cells, menus, sub-menus, pop-up menus, buttons etc. The navigation takes place by moving an indicator between items; the indicator may be change of colour of the item, a cursor, a pointer, a frame around the item or any visual or acoustic feature.

The method of navigating on an electronic display according to the second aspect comprises the steps of:

- providing a rotatably mounted roller member displaceable from an initial position to a selected displaced position of at least two predetermined displaced positions,
- rotating the roller member in a first or a second direction,
- detecting rotation of a coding member engaging the roller member in a manner so as to rotate when the roller member rotates,
- moving the indicator between items in a first or second direction in response to the detected rotation of the roller member,
- applying a predetermined force to a first or second part of the roller member,
- detecting the displaced position of the roller member, and
- moving the indicator between items in a third or fourth direction in response to the selected displaced position of the roller member.

Preferably, the present invention further provides a method of selecting an item on an electronic display. In this case, the roller member is furthermore displaceable to a third predetermined displaced position. The method comprises the steps of:

- moving the indicator to the item to be selected according to the above-mentioned method,
- applying a predetermined force to a middle part of the roller member,
- detecting the displaced position of the roller member, and
- selecting the item.

In a third aspect, the present invention provides a method of selecting an option on an electronic display displaying one or more items, at least one of which comprises two options. The method comprises the steps of:

- providing a rotatably mounted roller member displaceable from an initial position to a selected displaced position of at least two predetermined displaced positions, rotating the roller member in a first or a second direction, detecting rotation of a coding member engaging the roller member in a manner so as to rotate when the roller member rotates, moving between items in the menu in a first or second direction in response to the detected rotation of the roller member, applying a predetermined force to a first or second part of the roller member, detecting the displaced position of the roller member, and selecting a first or a second option in response to the selected displaced position of the roller member.

BRIEF DESCRIPTION OF THE DRAWINGS

Hereunder, preferred embodiments of electromechanical roller-key assemblies according to the invention are described with reference to the drawings, wherein.

DETAILED DESCRIPTION OF PREFERRED EMBODIMENTS

Figure 1:
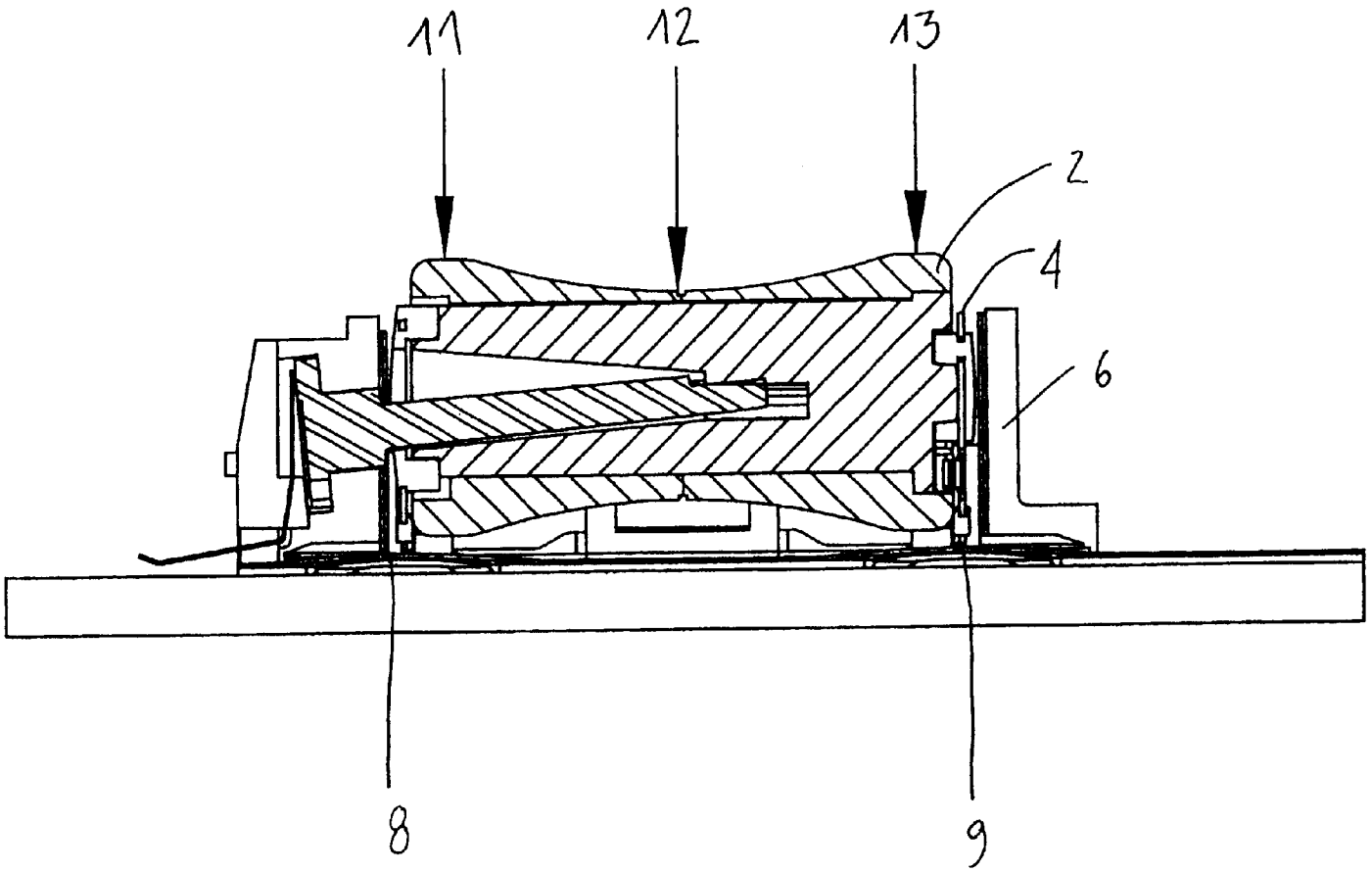
FIG. 1 shows a cross-sectional view of a first embodiment of an electromechanical roller-key assembly according to the present invention.

FIG. 1 shows an electromechanical roller-key assembly according to a first preferred embodiment of the invention. A plastic moulded roller member 2 is rotatably mounted in a carrier 4, which is displaceably mounted in a supporting frame 6. In principle, the moulded roller member 2 may take any form. Preferably, the centre section of the roller member (at arrow 12) has a smaller diameter than the end sections of the roller member (at arrows 11 and 13). Means for detecting the rotation of the roller member is connected to the roller member 2. A detent spring element is also mounted on the frame and returns the roller member to a relaxed position when it is vertically depressed. The mounting is so that when applying a force to the roller member at either end and perpendicular to the axis of the roller member (according to the arrows 11 or 13), the same end of the roller member will be displaced leaving the opposite end of the roller member in its relaxed position. Applying a force to the centre of the roller member and perpendicular to the axis of the roller member (according to the arrow 12) will displace the entire roller member.

Two actuator contacts (8 and 9) are positioned below the roller member and depressing corresponding parts of the roller member activates either or both contacts.

It is an essential aspect of the present invention that the roller key in excess of the navigation possibilities in rolling or scrolling, provides switch signal outputs corresponding to at least four different logic states, as illustrated in Table 1 below. This is achieved by having at least two actuator contacts, which can be depressed individually or simultaneously by depressing corresponding parts of the roller member.

TABLE 1

| Depressed | Contact 8 | Contact 9 |
|---|---|---|
| None | 1 | 1 |
| Left end | 0 | 1 |
| Right end | 1 | 0 |
| Middle part | 0 | 0 |

In order to determine the logic state of the switch signal output, it is necessary to be able to separate an output where both contacts 8 and 9 are activated, from two succeeding outputs corresponding to activation of the left contact 8 and the right contact 9 respectively. This can be solved by setting up a first time-interval $\Delta t_1$ and a second time-interval $\Delta t_2$. If a signal from contact 8, S8, and a signal from contact 9, S9, are temporally separated by more than $\Delta t_1$, then the signals are conceived as two individual signals from two succeeding depressions of the roller member. If however two signals S8 and S9 are temporally separated by less than $\Delta t_2$, then the signals are conceived as a combination S8+S9 from a single depression of the middle part of the roller member. Preferably the time-intervals $\Delta t_1$ and $\Delta t_2$ are the same. A control unit such as a microprocessor receiving the signals from contacts 8 and 9 can perform this determination, and generate digital outputs corresponding to the four logic states illustrated in Table 1.

Alternatively the same four logic states can be obtained using a combination of three contacts instead of two.

Figure 3:
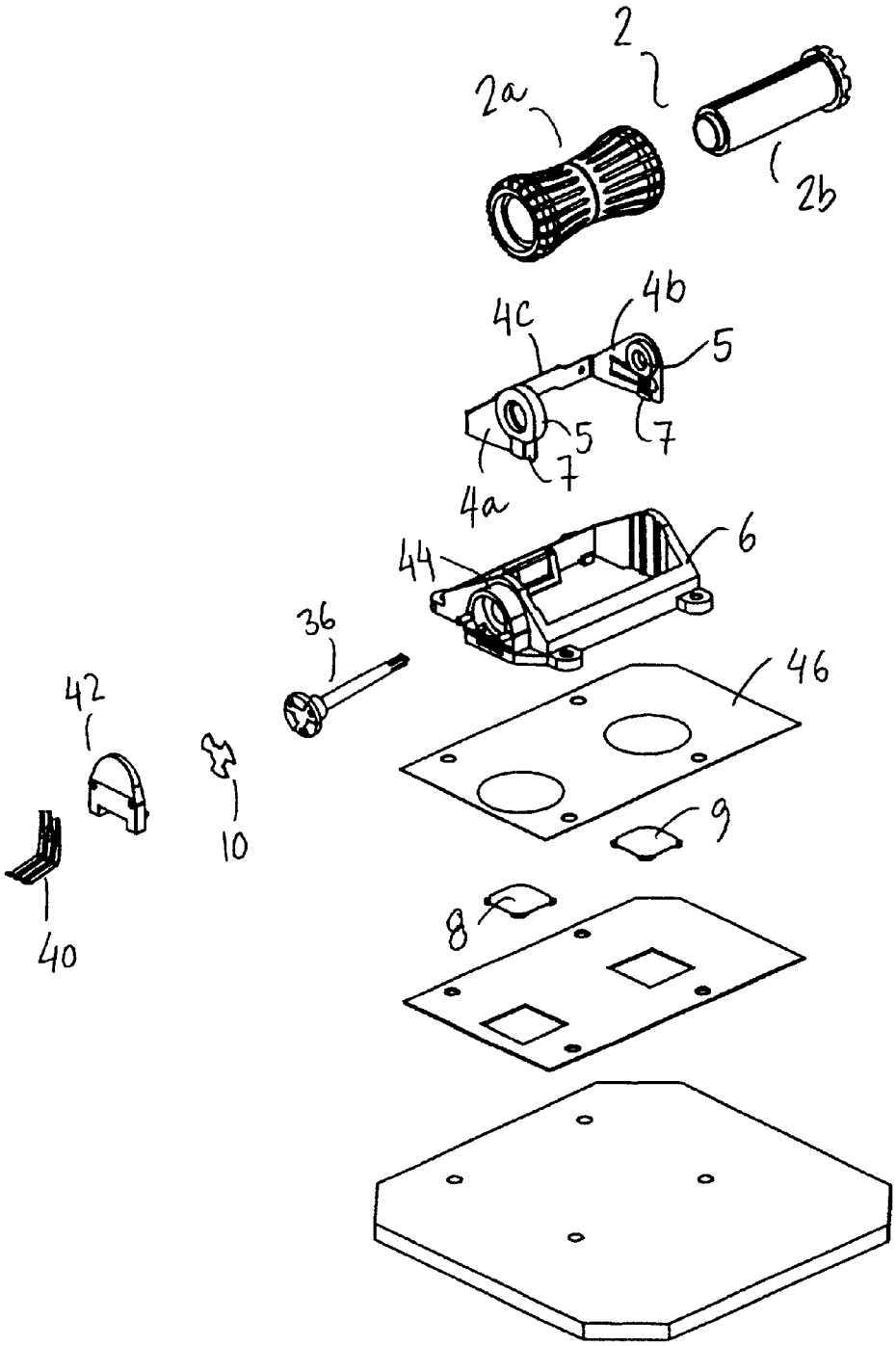
FIG. 3 shows a perspective view of various elements of the first embodiment of an electromechanical roller-key assembly according to the present invention.

FIG. 3 shows various elements of an electromechanical roller-key assembly according to the first preferred embodiment of the invention. A roller member 2 is rotatably mounted in a carrier 4. Preferably, the roller member 2 comprises a detent-bearing plug 2*b* and a soft rubber surface part 2*a* in order to provide traction for rotating the roller member with a finger. A first end surface 3 of the roller member 2 contains a corrugated groove adapted to contact a detent spring protrusion in the metal carrier 4 in order to create a tactile feedback when the roller member is rotated. A first part 4*c* of the carrier is rigidly mounted in a supporting structure such as the frame 6, or any casing or housing of an apparatus in which the roller key assembly is to be integrated. Actuator contacts 8 and 9 are positioned below the roller member and the frame. The contacts 8 and 9 are preferably membrane switches.

Preferably, a flexible/bendable shaft 36 transmits the rotation of the roller member 2 to a disc-shaped coding member 10. The coding member is adapted to receive the end part of the flexible/bendable shaft 36, which extends from the roller member 2 through a second part 4*a* of the carrier. Alternatively, the coding member engages the roller member directly, and may even be an integrated part of the roller member 2. Scanning means 40 detects the rotation of the coding member and provides output signals characterising the rotation.

As can be seen in FIG. 1, the flexible/bendable shaft 36 extends off-axis in the relaxed position of the roller member. Thereby the roller member has a longer idling when the roller member is vertically depressed. Moreover, the shaft is rotationally rigid in both the roller member 2 and the coding member 10, but is allowed to pivot in the mountings when the roller member is depressed. The coding member 36 (including shaft) and the detent-bearing plug 2*b* are preferably moulded in a low friction plastic resin.

The carrier 4 is preferably manufactured in a single piece of U-bend plate-shaped metal. The carrier is divided into a first part 4*c* rigidly mounted in the supporting frame 6 and two second parts (4*a* and 4*b*) adapted to support the roller member 2 at its end surfaces. A mechanical connection in the form of a crossbar or a shaft can be added between the two second parts 4*a* and 4*b* of the metal carrier after it has been bend into the U-shape, thereby providing a carrier of improved mechanical stability.

Utilising an insert moulding process, two plastic bearing elements 5 are attached to the second parts of the metal carrier. The plastic bearing elements are utilised to mount the roller member 2 in a precise predetermined and rotatably manner relative to the metal carrier 4.

By providing two indentations in the metal carrier 4, the second parts 4*a* and 4*b* are made displaceable in relation to the first part 4*c*. Accordingly, when the first part 4*c* is rigidly mounted in a supporting structure and a force is applied to the roller member 2, one or both of the second parts is displaced from a relaxed position to a displaced position depending of the point of action of the force. When displaced, a torsion spring force is created in the carrier for returning the second part(s), and thereby the roller member, to its relaxed position, when the applied force is removed. Hence, the carrier itself functions as a detent spring so that there is no need for a separate spring element. Furthermore, the spring and displacing feature of this type of carrier is not liable to be obstructed by dirt or small particles. Another advantage of the metal carrier is it may further act as a de-coupling element of electrostatic charge that may build up on the roller member.

Optionally, the displacement of one or both of the second parts may bring protrusions 7, which is integrated with the second parts of the metal carrier 4, in contact with one or both actuator contacts 8 or 9, arranged on e.g. a printed circuit board and positioned below the frame 6. Alternatively, the surface part of the roller member is adapted to actuate contacts 8 or 9 when depressed, e.g. by providing moulded protrusions on the roller member.

In another embodiment, the return spring force on the roller member is provided by means of a resilient material arranged below the roller member without supporting it. The resilient may be in the form of a pad, a membrane or a bulge providing a return spring force when depressed. The material in such pad, membrane or bulge can be rubber, plastic, foam, gel, silicone, metal, metal alloys or other. In this case the carrier holding the roller member needs only to be displaceable in relation to the frame, alternatively, the roller member can be mounted directly, and displaceable, in the frame.

The coding member 36 is preferably formed by pressing a metal disc 10 with a number of holes or notches onto a number of corresponding protrusions moulded in coding member 36. The holes (or notches) and protrusions may be arranged along a substantially circular surface path. Accordingly, the coding member 36 provides an encoding disk comprising a number of intermittently arranged conducting and non-conducting pads. By providing the protrusions on the coding member 36 with substantially the same height as the thickness of the metal disc 10, a plane surface of the coding member may be provided and contacted by the at least three contact members of the scanning means 40. Thereby, during rotation of the coding member, electrical contact is intermittently established between the three contact members, and pulse trains of differing phase with respect to each other may be provided at the leg parts.

The rotation of the roller member can be detected other types of coding means than the one presented above. An optical encoder (not shown) can be realised by providing an encoder disc with variably spaced or variably sized apertures together with an LED and a photodiode. Positioning the photodiode so as to receive light from the LED through apertures in the encoder disc, the rotation speed and direction of the coding member can be determined from the pulse trains emitted by the photodiode. By using a similar scheme a magnetic encoder can be utilised.

Figure 4:
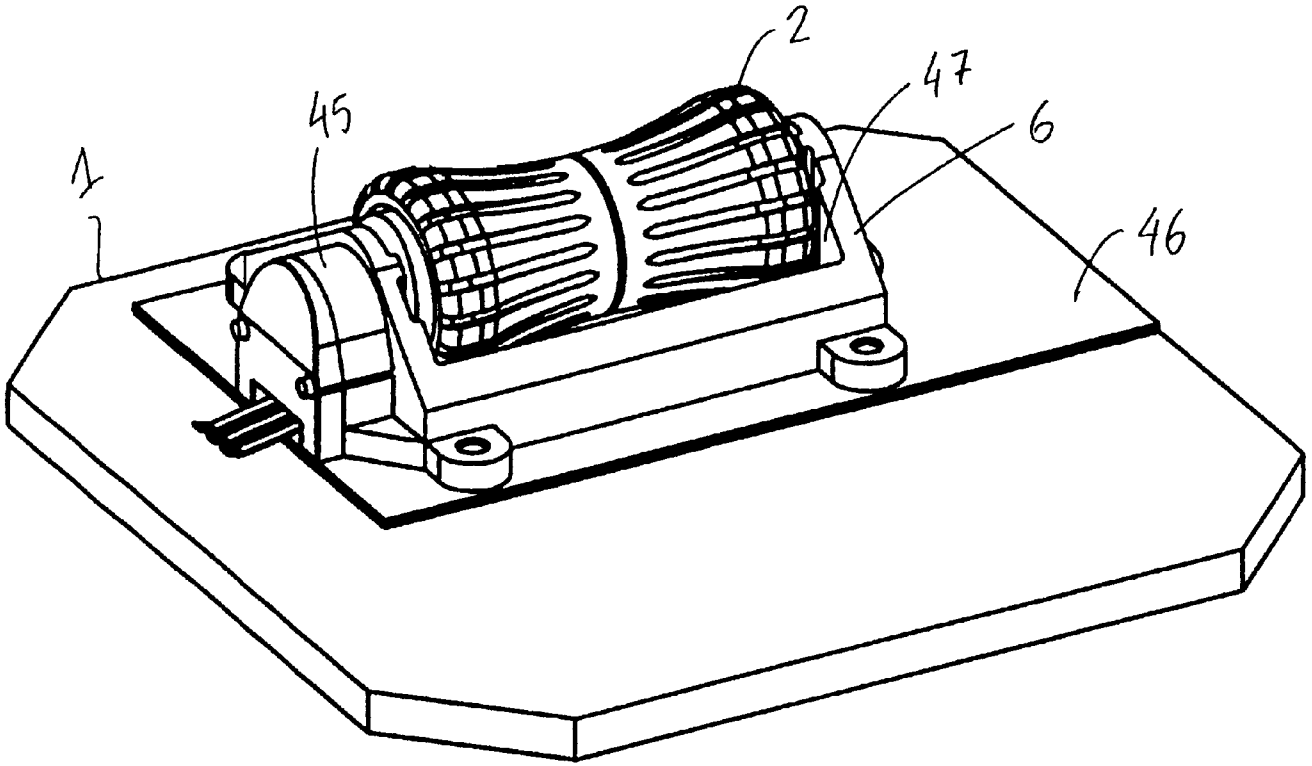
FIG. 4 shows a perspective view of the first embodiment of the electromechanical roller-key.

It is desirable to protect electronic and mechanical parts from moisture and external contamination. Preferably only the roller member, the carrier and the upper rim of the frame are exposed. In the first embodiment, shown in parts in FIG. 3 and assembled in FIG. 4, the roller member 2 and the carrier 4 can be mounted in a substantially moisture- or watertight well 47 separating them from the other parts of the assembly.

The coding member 10 and scanning means 40 in FIG. 3 are preferably arranged in a closed cavity 45 for protection against moisture, small particles and other contamination. In FIG. 3, a cavity is constituted by a passage 44 formed in the frame 6 with one end closed by a lid 42. The lid 42 can be snap-fitted to the frame. Furthermore, an inner surface in the lid 42 can be provided with a projection abutting against each of the contact members of the scanning means to provide a contact or bias force between the contact members and the encoding disc.

The actuator contacts 8 and 9 are preferably protected against contamination. By abutting the lower rim of the frame 6 to a layer of sealing foil 46 of substantially moisture- or watertight material, the well 47 is formed by the sealing foil 46, the frame 6 and the sealed connection to the closed cavity 45. The sealing foil layer must be flexible for allowing the contacts to be actuated by the carrier or roller member. Optionally the layer is hard with resilient areas over the contacts.

Optionally the well 47 is connected to a drain (not shown) for draining moisture and dirt from the well. The drain can be a pipe or hose with a first opening forming a drain-hole from the well and the second end forming an outlet at the opposite side (or elsewhere) on the apparatus.

Figure 2:
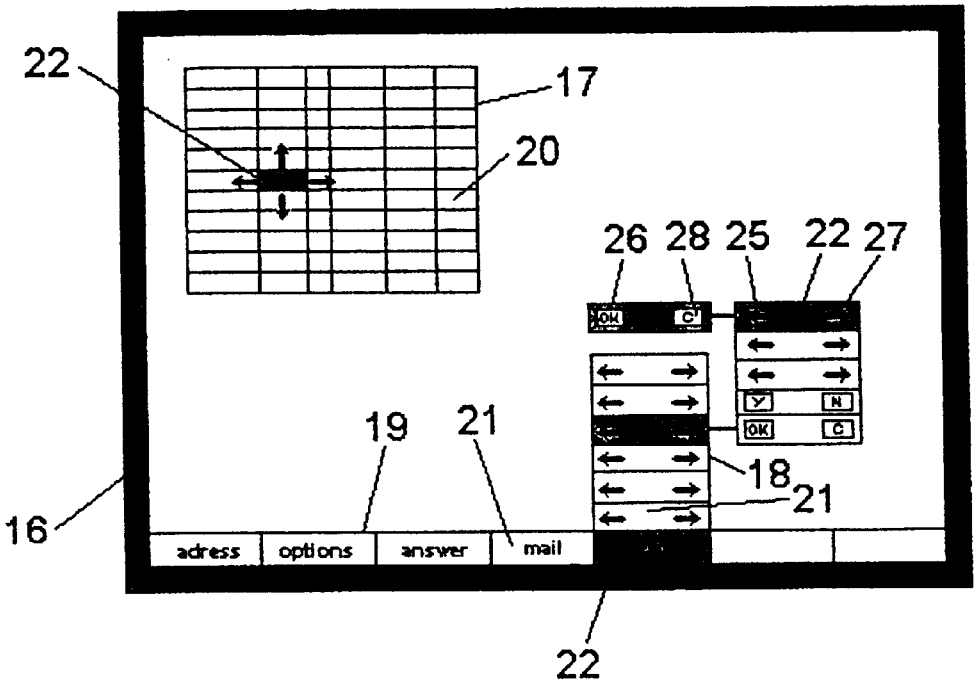
FIG. 2 is an illustration of an electronic display with menus and a table.

The output signals provided by the contacts 8 and 9 and the rotation detection means is in a preferred embodiment used to navigate between and select items in menus and tables on an electronic display 16, as shown in FIG. 2. According to FIG. 2, the electronic display displays three main areas, a table 17 and two menus 18 and 19, each comprising one or more items, such as a cell 20 in the table 17 or a menu option 21 in the menus 18 and 19. Each item can be assigned as active by moving an indicator 22 to the item. An active item can e.g. lead to other items as indicated by arrows 25 and 27, comprise selectable buttons 26 and 28, activate pop-up menus, or be adapted to receive inputs as for the cell 20. In FIG. 2 the indicator 22 is change of colour of the item, it could also be accomplished by a cursor, a pointer, a frame around the item or any visual or acoustic feature.

The indicator 22 may be moved to other areas or items e.g. up or down in 17 and 18, by rotating the roller member in the roller key assembly. The indicator may also be moved to other areas or items by depressing a part of the roller member corresponding to the desired direction of movement, e.g. left or right in 17 and 19. To move left, the left end part of the roller member is depressed according to the arrow 11 on FIG. 1; to move right, the right end part is depressed according to the arrow 13 on FIG. 1.

In FIG. 2, some items comprise other menu options 26 and 28, such as selectable buttons. In a preferred embodiment, such items can be selected by making one of the items the active item by pressing left for 26 or right for 28, and thereafter select the option by pressing the middle part of the roller member. Alternatively, if there is only two options to chose between, the options can be selected directly by pressing left for selecting 26 or right for selecting 28. Also, in the table 17 a cell can be selected simply my moving the indicator to the cell. Alternatively, items can be selected by voice activation or a touch pen if the indicator is already moved to the item.

As described in relation to FIG. 2, the roller key assembly according to the present invention provides a major advantage in that the rolling and the switch signal outputs provide possibilities for two-dimensional navigation. Furthermore, the roller key assembly provides switch signals for selecting active items.

What is claimed is:

1. A roller-key assembly comprising, a carrier, a roller member supported by the carrier and being rotatably mounted in relation to the carrier, a coding member engaging the roller member in a manner so as to rotate when the roller member rotates, the carrier being mounted in a supporting structure and being at least partly displaceable relative to the supporting structure so as to render the roller member displaceable from an initial position to a selected displaced position of at least two predetermined displaced positions, means for detecting rotation of the coding member in relation to the supporting structure, means for generating a return spring force that returns the roller member to the initial position from the selected displaced position, switching means being adapted to indicate the selected displaced position of the roller member, and a sealing foil arranged between the switching means and the roller member so as to separate the switching means from the roller member by a substantially moisture- or watertight layer, wherein the roller member is mounted within a substantially moisture- or watertight well formed by the supporting structure and the sealing foil, said well having an opening arranged oppositely to the sealing foil.

2. A roller-key assembly according to claim 1, further comprising means for draining liquids and small particles from within the well, said means comprising a first opening positioned within the well.

3. A roller-key assembly comprising, a carrier, a roller member supported by the carrier and being rotatably mounted in relation to the carrier, a coding member engaging the roller member in a manner so as to rotate when the roller member rotates, the carrier being mounted in a frame and being at least partly displaceable relative to the frame so as to render the roller member displaceable from an initial position to a selected displaced position of at least two predetermined displaced positions, means for detecting rotation of the coding member in relation to the frame, wherein the carrier comprises a first and a second part, the first part being substantially rigidly connected to the frame, the second part being adapted to support the roller member and being displaceable relative to the first part of the carrier, the second part comprising means for generating a return spring force that returns the roller member to the initial position from the selected displaced position, the return spring force generating means forming an integral part of the second part of the carrier.

4. A roller-key assembly according to claim 3, wherein the roller member is furthermore displaceable relative to the frame to a third predetermined displaced position.

5. A roller-key assembly according to claim 4, wherein the roller member is furthermore displaceable relative to the frame to a third predetermined displaced position and wherein a combination of the at least two predetermined displaced positions is in the third displaced position.

6. A hand-held electronic apparatus comprising a roller-key assembly according to claim 5, further comprising switching means being adapted to indicate the selected displaced position of the roller member.

7. A hand-held electronic apparatus according to claim 6, wherein the switching means comprises:

first switching means adapted to generate a first switch signal indicating that the roller member is in the first predetermined position, and second switching means adapted to generate a second switch signal indicating that the roller member is in the second predetermined position.

8. A hand-held electronic apparatus according to claim 7, wherein the carrier is adapted to actuate the switching means.

9. A hand-held electronic apparatus according to claim 7, wherein the roller member is adapted to actuate the switching means.

10. A hand-held electronic apparatus according to claim 7, wherein the switching means comprises one or several membrane switches.

11. A hand-held electronic apparatus according to claim 10, wherein the membrane switches comprise a resilient material and are adapted to provide a return spring force to the roller member when the roller member is displaced towards the switching means.

12. A hand-held electronic apparatus according to claim 7, further comprising a resilient material arranged between said switching means and the roller member so as to provide a return spring force to the roller member when the roller member is displaced towards the switching means.

13. A hand-held electronic apparatus according to claim 12, wherein said resilient material is a material selected from the group of: rubber, plastic, foam, metal, metal alloys.

14. A hand-held electronic apparatus according to claim 7, further comprising a sealing foil arranged between the switching means and the roller member so as to separate the switching means from the roller member by a substantially moisture- or watertight layer.

15. A hand-held electronic apparatus according to claim 14, wherein the roller member is mounted within a substantially moisture- or watertight well formed by the frame and the sealing foil, said well having an opening arranged opposite the sealing foil.

16. A hand-held electronic apparatus according to claim 15, further comprising means for draining liquids and small particles from within the well, said means comprising a first opening positioned within the well.

17. A hand-held electronic apparatus according to claim 7, wherein the hand-held apparatus is selected from the group of: mobile phones, remote controls pagers handheld computers, discmans, MP3-mans, GPS navigators or personal digital assistants.

18. A hand-held electronic apparatus according to claim 7, further comprising a controller operationally connected to the switching means of the roller-key assembly and adapted to receive the first and second switch signals, said controller being adapted to generate:

a first output if the first switch signal precedes the second switch signal with more than a first delay time, $\Delta t_1$, a second output if the second switch signal precedes the first switch signal with more than $\Delta t_1$, the first output indicating that the first predetermined displaced position was selected and the second output indicating that the second predetermined displaced position was selected.

19. A hand-held electronic apparatus according to claim 18, wherein the controller is further adapted to generate:

a third output if the time interval between the first switch signal and the second switch signal is less than a second delay time, $\Delta t_2$, the third output indicating that the third predetermined displaced position was selected.

20. A hand-held electronic apparatus according to claim 19, wherein the value of $\Delta t_1$ equals the value of $\Delta t_2$.

21. A hand-held electronic apparatus according to claim 18, wherein the value of $\Delta t_1$ is larger than about 10 ms.

22. A hand-held electronic apparatus according to claim 18, wherein the value of $\Delta t_1$ is larger than about 50 ms.

23. A roller-key assembly according to claim 3, wherein the selected displaced position is chosen by applying a predetermined force to an associated part of the roller member.

24. A roller-key assembly according to claim 23, wherein the roller member is displaceable to a first and a second predetermined displaced position, the first predetermined displaced position being selected by applying the predetermined force to a first end part of the roller member, and the second predetermined displaced position being selected by applying the predetermined force to a second end part of the roller member.

25. A roller-key assembly according to claim 23, wherein the roller member is displaceable to a first, a second and the third displaced positions, the first predetermined displaced position being selected by applying the predetermined force to a first end part of the roller member, the second predetermined displaced position the selected by applying the predetermined force to a second end part of the roller, and the third predetermined displaced position being selected by applying the predetermined force to a substantially middle part of the roller member.

26. A roller-key assembly according to claim 3, wherein the carrier is made from a plate-shaped resilient material.

27. A roller-key assembly according to claim 26, wherein the first part and the second part of the carrier are separated by one or more indentations of the carrier to provide regions with a higher resiliency than regions of the carrier abutting the one or more indentations.

28. A roller-key assembly according to claim 3, further comprising a shaft providing a substantially rotationally rigid connection between the roller member and the coding member, said shaft being mounted so as to allow for at least parts of the roller member to be displaced in relation to the coding member along directions substantially perpendicular to the axis of rotation of the roller member.

29. A roller-key assembly according to claim 28, wherein the roller member comprises a bore and wherein at least part of the shaft is positioned within said bore.

30. A roller-key assembly according to claim 3, wherein the frame comprises a cavity housing at least the coding member and the means for detecting rotation of the coding member, said cavity being substantially moisture- or water-tight.

31. A hand-held electronic apparatus comprising a roller-key assembly according to claim 3.

32. A method of moving an indicator between items displayed on an electronic display, said method comprising the steps of providing a roller-key assembly according to claim 3, and moving the indicator between items in a first and a second direction by rotating the roller member in a first or a second direction, and detecting the corresponding rotation of the coding member engaging the roller member.

33. A method according to claim 32, further comprising the step of moving the indicator between items in a third and a fourth direction by applying a predetermined force to a first or second part of the roller member so as to displace the roller member from the initial position to one of the at least two predetermined displaced position.

34. A method according to claim 32, further comprising the step of selecting an item by applying a predetermined force to a middle part of the roller member so as to displace the roller member from the initial position to a third predetermined displaced position.

* * * * *